US006601491B1

(12) United States Patent
Jensen

(10) Patent No.: US 6,601,491 B1
(45) Date of Patent: Aug. 5, 2003

(54) TENSIVE CUTTING ASSEMBLY

(76) Inventor: Raleigh J. Jensen, 1986 Silvercreek La., Boise, ID (US) 83706

( * ) Notice: Subject to any disclaimer, the term of this patent is extended or adjusted under 35 U.S.C. 154(b) by 0 days.

(21) Appl. No.: 09/550,538

(22) Filed: Apr. 14, 2000

Related U.S. Application Data

(63) Continuation-in-part of application No. 09/008,551, filed on Jan. 16, 1998, now abandoned.
(60) Provisional application No. 60/046,096, filed on May 9, 1997.

(51) Int. Cl.[7] ..... B26D 1/03; B26D 5/00
(52) U.S. Cl. ..... 83/62.1; 83/581.1; 83/662; 83/856; 83/858; 83/932
(58) Field of Search ..... 83/62, 62.1, 72, 83/402, 404.3, 405, 522.12, 662, 699.51, 699.61, 856, 857, 858, 932, 425.2, 425.3, 581.1, 694, 651.1

(56) References Cited

U.S. PATENT DOCUMENTS 690,512 A * 1/1902 Boos ..... 30/303 X
1,097,479 A * 5/1914 Starr ..... 83/858
2,609,564 A * 9/1952 Grimm ..... 425/301
3,112,781 A * 12/1963 Popeil ..... 83/435.15
3,728,919 A * 4/1973 Scott ..... 83/62
4,137,807 A * 2/1979 Schaumberg ..... 83/651.1 X
5,343,623 A * 9/1994 Cole et al. ..... 30/304
5,904,083 A * 5/1999 Jensen et al. ..... 83/62.1 X
5,905,440 A * 5/1999 Julian et al. ..... 83/62.1 X
5,911,808 A * 6/1999 Mendenhall ..... 83/581.1
6,041,682 A * 3/2000 Jensen et al. ..... 83/62.1 X

* cited by examiner

*Primary Examiner*—Clark F. Dexter
(74) *Attorney, Agent, or Firm*—Joseph W. Holland

(57) ABSTRACT

A tensive cutting assembly includes a tensionable cutting member formed of a strip of material, typically metal, which is formed having a serpentine configuration. The tensionable cutting member is removably mounted on a tensive cutting head. The tensive cutting head includes an aperture formed through its cross section for passage of food product during the cutting process. The tensive cutting head includes first and second opposing head members, the distance between which is adjustable and which may be driven apart by a cutting member tensioning device. The tensive cutting assembly may also include a breakage detecting device for detecting breakage during use of the tensive cutting assembly.

2 Claims, 7 Drawing Sheets

TENSIVE CUTTING ASSEMBLY

RELATED APPLICATIONS

This application is a continuation-in-part of and claims the priority of an application entitled Tensive Cutting Assembly filed Jan. 16, 1998, Ser. No. 09/008,551, now abandoned which claims the priority of a Provisional Application Ser. No. 60/046,096 entitled Tensionable Monoblade Cutter Assembly, filed May 9, 1997.

BACKGROUND

1. Technical Field

This invention relates to the cutting of food product with hydraulic food cutting devices. In particular it relates to a tensive cutting assembly for cutting food product.

2. Background of the Invention

A variety of "hydro-cutting" devices for cutting food product into slices and sticks are known in the art and typically include a cutting assembly comprising a plurality of sharpened cutting knives arranged and held in a stationary array with a means to propel the food product through the knife array. The food product may be conveyed through the knife array by suspending the food product in a fluid stream, such as water.

The typical hydraulic food cutting apparatus in use today has a receiving tank filled with a hydraulic carrier fluid, usually water, into which food product is dumped. A food pump draws its suction from the receiving tank, and pumps carrier fluid and the suspended food product from the tank into an inlet tube which aligns the food product before impact with a cutter assembly. Cutter blade assemblies include typically a frame and a stationary knife array typically including a plurality of individual knife blades mounted in a parallel and converging sequence to each other. If the food product is to be cut into slices, only a single such array need be utilized. However, if the food product is to be cut into sticks, such as potatoes for French fries, two such arrays are utilized with the knives in one array extending generally perpendicular to the knives in the other array.

Cole, et.al., U.S. Pat. No. 5,343,623 Knife Assembly for Cutting a Food Product, discloses a knife blade for use in a cutting assembly comprising a plurality of sharpened cutting knives arranged and held in a stationary array. Each blade includes a sharpened cutting edge, and holes adapted to accommodate a means for attaching the knife blades to a mounting member. The centers of the mounting holes lie in the plane of the cutting edge. The plurality of sharpened knife blades are mounted in the knife assembly so that a tension force is exerted on the knife blades in the plane of the cutting edge. The cutting edges of knives in an array are located in a common plane.

SUMMARY OF THE INVENTION

According to the present invention a tensive cutting assembly includes a tensionable cutting member formed of a strip of material, typically, metal which is formed having a serpentine configuration. The tensionable cutting member is removably and interchangeably mounted on a tensive cutting head. The tensive cutting head includes an aperture formed through its cross section for passage of food product during the cutting process. The tensive cutting head includes first and second opposing head members, the distance between which is adjustable. The tensive cutting head may be configured having at least one return about which the bend or bends of the tensive cutting member is positioned.

The ends of the tensive cutting member are secured in one or more clamping members. Tension is applied to the tensive cutting member by increasing the distance between the first and second opposing head members along a plane that lies substantially coplanar to the face of the tensive cutting head and perpendicular to the bearing faces of the returns.

One embodiment of the invention includes a plurality of returns divided into first and second sets of returns, the first and second sets are divided into opposed pairings of returns. The first set of returns are formed on or attached to the face of the first opposing head member and the second set of returns are formed on or attached to the face of the second opposing head member. The returns are arranged sequentially, with an equal distance typically being observed between each of the sequential returns. Opposing sets of returns are offset laterally from one another a distance substantially equal to the distance between two sequential tensionable cutting member leg segments. This configuration allows the tensionable cutting member to be fit over the opposing sets of returns in a manner that permits a substantially parallel arrangement of the tensionable cutting member leg segments. The distance between sequential returns determines the distance between leg segments and therefore a cross-sectional dimension of the cut food product.

Each return is configured having a bearing face about which the bend of the tensionable cutting member is placed. In one embodiment of the invention, the bearing face of the return is substantially perpendicular to the face of the tensive cutting head and the plane on which the first and second opposing head members are driven apart. This feature allows the tensive cutting member to be tensioned in such a manner that the tension across the entire width of the tensive cutting member is substantially equal. This arrangement effectively eliminates the creation of stress risers in the tensive cutting member that may otherwise be propagated in devices that tension a blade or cutting member unequally across the width of the blade or along a single edge. The bearing face may also include a low friction surface against which the tensionable cutting member is fit and tensioned. In the preferred embodiment of the invention, the height of the bearing face should be substantially equal to or greater than the width of the tensionable cutting member so that, as the tensionable cutting member is tensioned, substantially equal tensile forces are established across the width of the tensionable cutting member.

The tensive cutting head may be machined of type 17-4 PH stainless steel, although other materials and forming methods known to those skilled in the art may be employed to practice the present invention.

The tensionable cutting member includes a strip of material formed having at least two leg segments and at least one bend connecting the two leg segments. In one embodiment of the invention, the tensionable cutting member is formed having a plurality of leg segments and a plurality of bends producing a continuous and generally serpentine configuration. Either the first edge or the second edge of the tensionable cutting member may be employed as the cutting edge of the tensionable cutting member. The cutting edge of the tensionable cutting member may be unsharpened and the edges may be rounded or otherwise treated or dressed in order to eliminate edge and surface irregularities.

The tensionable cutting member may be formed of a strip of sheet metal having a thickness of 0.005 inches to 0.0015 inches and a width of 0.375 inches to 0.625 inches. In one embodiment of the invention, the tensionable cutting member is formed of a hardened 301 stainless steel having a thickness of 0.008 inches and a width of 0.50 inches. The material used to form the tensionable cutting member should exhibit adequate tensile strength to perform as a tensionable cutting member and adequate ductility to allow its serpentine configuration. The material should also exhibit a yield strength less than the tensile strength. The tensionable cutting member may be formed of a strip of sheet metal having a tensile strength of 175,000 psi to 275,000 psi and a yield strength of 80,000 psi to 180,000 psi. In one embodiment of the invention, the tensionable cutting member is formed from a hardened type 301 stainless steel having a tensile strength of approximately 185,000 psi and a yield strength of approximately 140,000 psi. Materials having compositions or properties similar to the hardened 301 series stainless steel, or a type 17-4 PH stainless steel, are known to those skilled in the art and may be employed in the present invention as a tensionable cutting member.

In one embodiment of the invention the tensive cutting assembly includes a first tensionable cutting member mounted to the first and second opposing head members, presenting a first cutting array and a second tensionable cutting member mounted to a third and a fourth opposing head members on the second face of the tensive cutting head, presenting a second cutting array. The second cutting array is commonly rotated typically at 90° to the first cutting array. This embodiment of the tensive cutting assembly, when employed within a hydraulic cutting device, renders cut food product having stick configuration.

In another embodiment of the invention, the tensive cutting head may be configured having only a single or first array, which will render cut food product having a slabbed configuration.

The tensive cutting assembly also includes a cutting member tensioning device for applying a tensive force along the length of the tensionable cutting member. Alternate means for tensioning the tensionable cutting member may include means integral to the tensive cutting head such as mechanical means such as screws, machine heads, levers or levered cams, or hydraulic means. Alternately, a cutting member tensioning device may be employed which is attached to the tensive cutting head only during tensioning, and releasable after the tensionable cutting member is tensioned and the ends of the tensionable cutting members are secured. In one embodiment of the invention, tensioning is achieved using a pair of tension adjustment screws which adjust the distance between opposing head members and therefor between opposing sets of returns. The tension adjustment screws project through and engage a threaded aperture in the first opposing head member, with the second or distal ends of the tension adjustment screws being insertable in a pair of holes located in the second opposing head member. As the tension adjustment screws are advanced in their threads, a force is exerted along a tension vector increasing the distance between the first and second opposing head members, thereby tensioning the tensionable cutting member. This method of blade tensioning is capable of achieving tensive forces along the tension vector in the range of 100,000 psi to 200,000 psi.

The tensive cutting assembly may also include a breakage detecting device for detecting breakage during use of the tensive cutting assembly. The device for detecting breakage of a tensionable cutting member includes a fluid containment cell and a pressure release mechanism. The tensionable cutting member failure detecting device also includes a fluid pressure source fluidly connected to the fluid containment cell. The connector for connecting the fluid pressure source to the fluid containment cell may include a variety of mechanical connectors including threaded fittings, compression fittings or quick disconnect type fittings.

The fluid containment cell may be configured as a cylinder formed in either the first or the second opposing head members of the tensive cutting head. The pressure release mechanism includes a stop which is configured to compressively mate against a seat formed in an aperture located in an end of the cylinder. When the stop is compressively mated against the seat, fluid will not escape from the fluid pressure chamber and pressure may be maintained within the chamber. In this embodiment of the invention, the stop is configured as a sliding stop which opposes the seat and which cooperates with a compressive member for holding the sliding stop against the seat of the fluid pressure chamber and sealing the fluid pressure chamber.

In the event that the compressive force against the sliding stop is relieved, fluid escapes from the fluid pressure chamber causing the fluid containment cell to depressurize. Because the compressive force against the seat is created by the tensile forces exerted against the tensionable cutting member by the tensioning screws, in the event of a failure or breakage of the tensionable cutting member, pressure escapes from the fluid pressure chamber.

The tensionable cutting member failure detecting device also includes a pressure sensing device fluidly connected to the fluid containment cell for sensing a decrease in pressure in the system. The pressure sensing device may be configured as a pressure switch which includes a set of electrical contacts which are activated by a change in pressure against a diaphragm. The opening or closing of the contacts in response to pressure against the diaphragm may signal a variety of other devices including controllers, switches, line switchers, relays and/or motors.

The tensionable cutting member failure sensing device may also include a flow regulator for regulating fluid pressure from the pressure source to the fluid containment cell and a pressure gauge for indicating system pressure.

Other advantages will become apparent to those skilled in the art from the following detailed description read in conjunction with the appended claims attached hereto.

It should be understood that the referenced drawings are not to scale and are intended as representations. The drawings are not necessarily intended to depict the functional and structural details of the invention, which can be determined by one of skill in the art by examination of the descriptions and claims provided herein.

DETAILED DESCRIPTION OF THE INVENTION

Figure 1:
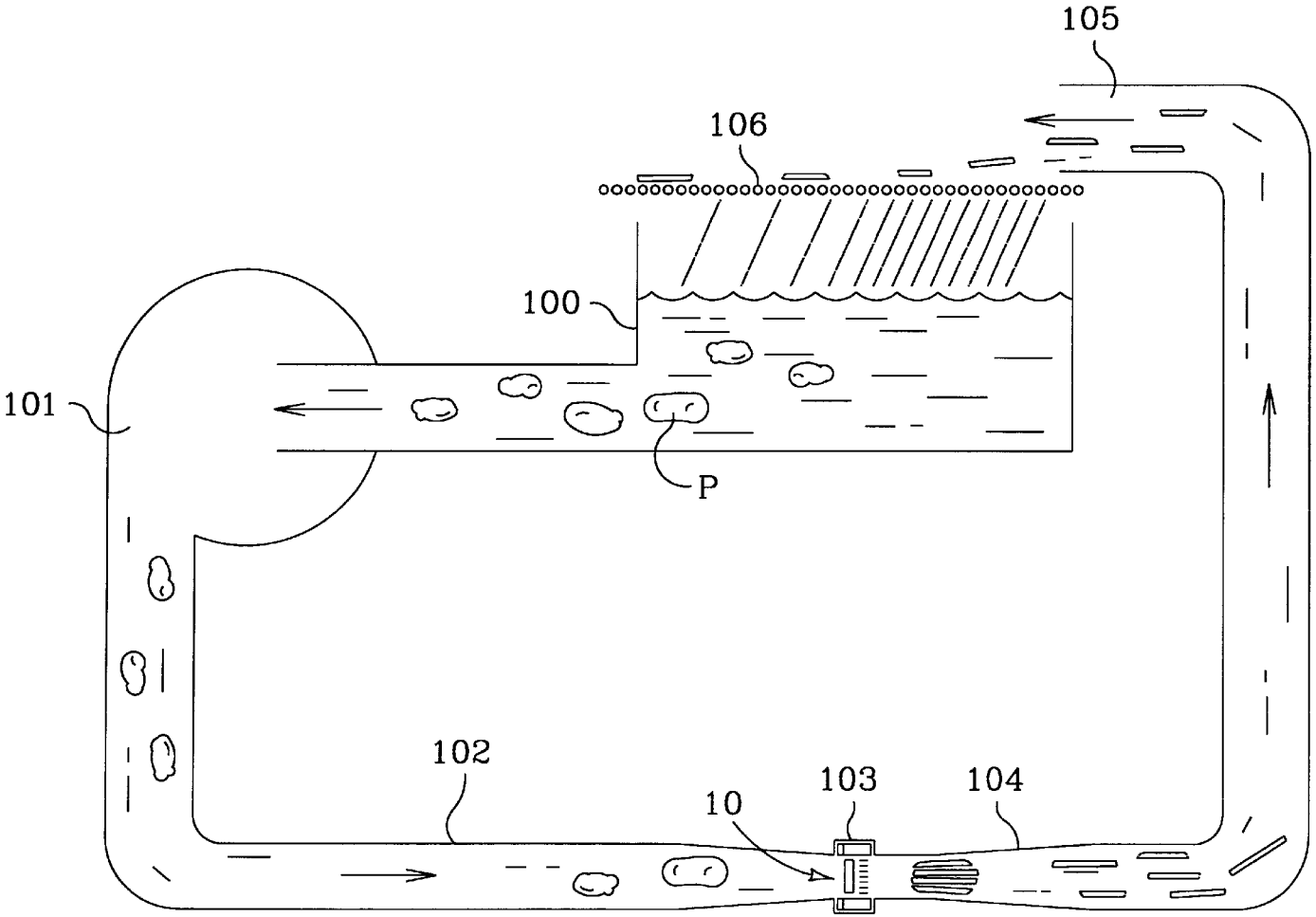
FIG. 1 is a schematic representation of a hydro-cutting system.

Referring to FIG. 1, food product P, such as raw, whole potatoes, are introduced into food product tank 100. Food product tank 100 contains water in which the food product is suspended. Food product P and water are drawn through food pump 101 into inlet tube 102. At its downstream end, inlet tube 102 is hydraulically connected to tensive cutting assembly housing 103 which houses tensive cutting assembly 10. Food product P passes through tensive cutting assembly housing 103 and is discharged in outlet tube 104. From this point, the sliced food product P is carried through processed food product discharge 105 to de-watering conveyor 106.

Figure 2:
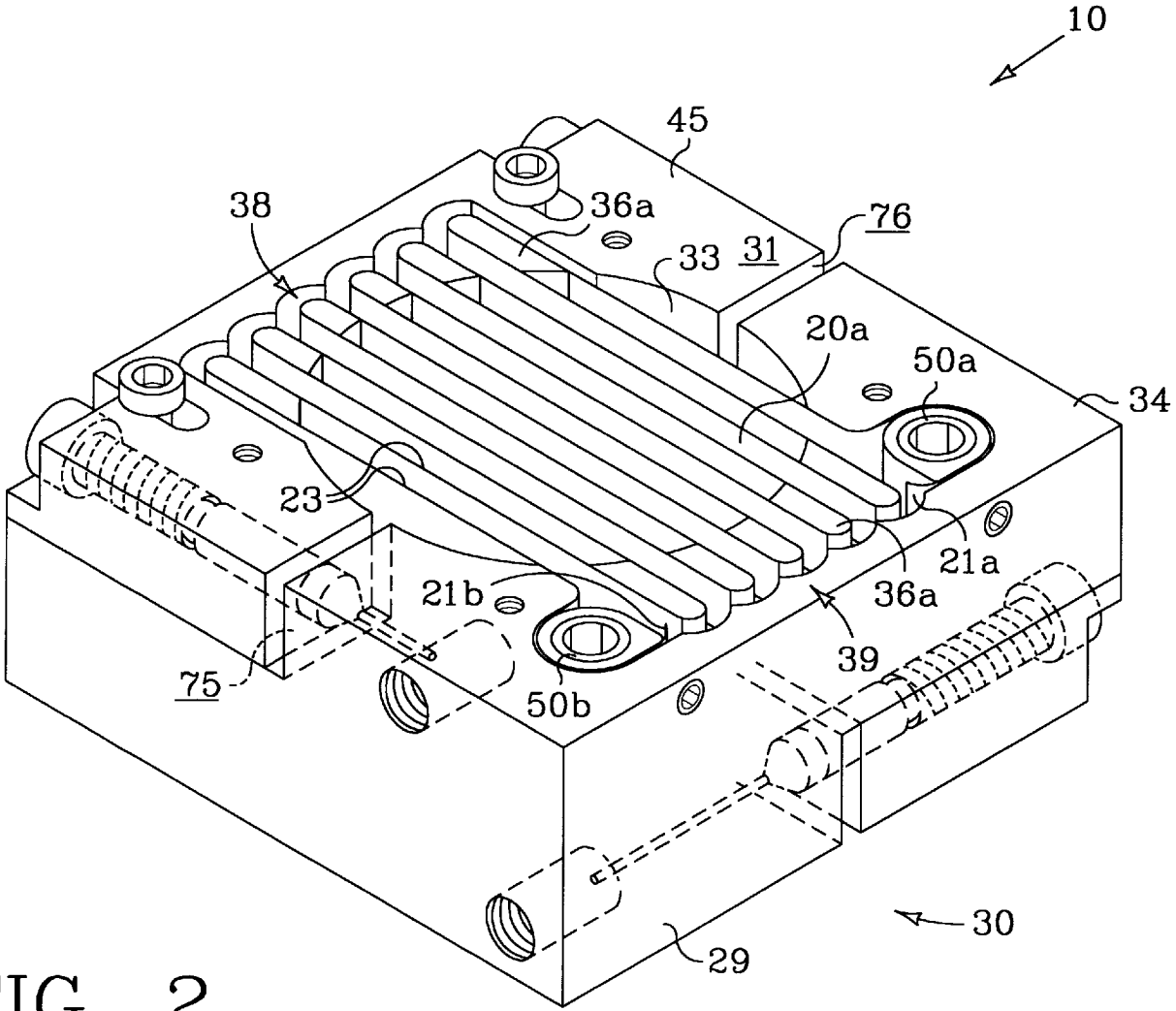
FIG. 2 is a representational perspective view of a first embodiment of the tensive cutting assembly.

FIG. 2 shows tensive cutting assembly 10 including tensive cutting head 30. Tensive cutting head 30 includes monolithic portion 29 which includes first face 31 and a second face (not shown in FIG. 2). Aperture 33 is formed through the cross-section of monolithic portion 29 of cutting head 30. In the embodiment of the invention shown in FIG. 2, the first and second opposing head members include first moveable plate 45 and first raised portion 34 respectively. Tensive cutting head 30 includes first plurality of returns 36*a*. In this case, first moveable plate 45 includes first moveable set of returns 38 and first raised portion 34 is configured including first fixed set of returns 39. First tensionable cutting member 20*a*, including leg segments 23, is positioned about first plurality of returns 36*a* with first end 21*a* and second end 21*b* secured in first clamping assembly 50*a* and second clamping assembly 50*b* respectively.

Referring again to FIG. 2, monolithic portion 29 of tensive cutting head 30 is configured having first face 31 which includes first raised portion 34 including plurality of returns 36*a*. Plurality of returns 36*a* are divided into first fixed set of returns 39 and first moveable set of returns 38. First moveable plate 45 is held against first face 31 in a slidingly adjustable relationship to first raised portion 34 and inner face 75. The distance between inner face 75 and inner face 76 of first movable plate 45 is adjustable using first tension adjustment screw 55*a* (shown in FIG. 3), and second tension adjustment screw 55*b*.

Figure 3:
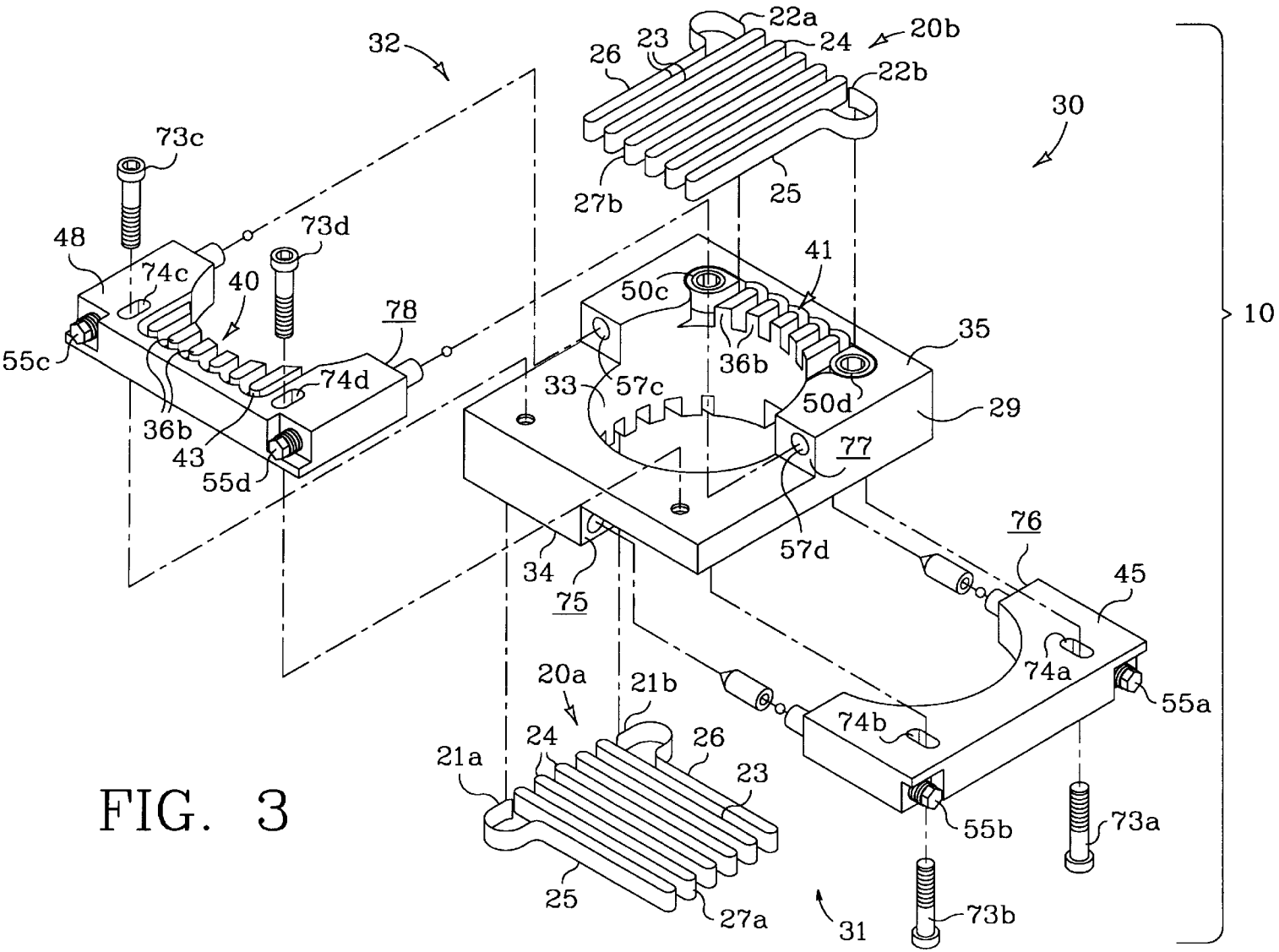
FIG. 3 is an exploded representational perspective view of a first embodiment of the tensive cutting assembly.

Referring to FIG. 3, tensive cutting head 30 is formed having monolithic portion 29 which is configured having first raised portion 34 on first face 31 and second raised portion 35 on second face 32. Second moveable plate 48 is slideable against second face 32. Second moveable plate 48 includes a plurality of returns 36*b* which are divided into second fixed set of returns 41 and second moveable set of returns 40. Second raised portion 35 includes second fixed set of returns 41 and second moveable plate 48 includes second moveable set of returns 40. Second movable plate 48 is held against second face 32 in a slidingly adjustable relationship to second raised portion 35. Aperture 33 is formed through the cross section of tensive cutting head 30 allowing passage of food product through tensive cutting assembly 10.

Tensive cutting assembly 10 includes first tensionable cutting member 20*a* removably mountable to first raised portion 34 and first movable plate 45. Similarly, second tensionable cutting member 20*b* is removably mountable to second raised portion 35 and second moveable plate 48. First tensionable cutting member 20*a* and second tensionable cutting member 20*b* are formed from a strip of sheet metal and include a plurality of leg segments 23 and a plurality of bends 24 producing a continuous and generally serpentine configuration. First tensionable cutting member 20*a* is further configured having first end 21*a* and second end 21*b*. Second tensionable cutting member 20*b* is similarly configured having first end 22*a* and second end 22*b*. Either first edge 25 or second edge 26 may be employed as a cutting edge depending upon orientation when installed in tensive cutting head 30.

Referring to FIG. 3, the distance between inner face 77 of second raised portion 35 and inner face 78 of second movable plate 48 is adjustable using third tension adjustment screw 55*c* and fourth tension adjustment screw 55*d*.

As shown in FIG. 3, third tension adjustment screw 55*c* engages third threaded aperture 56*c* (not shown), and seats in third hole 57*c*. Similarly, fourth tension adjustment screw 55*d* engages fourth threaded aperture 56*d* (notshown), and seats in fourth hole 57*d*.

Second movable plate 48 is secured in position on second face 32 by third retaining screw 73*c* which passes through third slot 74*c* and fourth retaining screw 73*d* which passes through fourth slot 74*d*. Second moveable set of returns 40 is formed on the face of second moveable plate 48 near a second opposing peripheral edge of second moveable plate 48 such that when second tensionable cutting member 20*b* is positioned about second fixed set of returns 41 and second moveable set of returns 40, leg segments 23 of second tensionable cutting member 20*b* extend across aperture 33.

In the embodiment of the invention shown in FIG. 3, first tensionable cutting member 20*a* is attached to first raised portion 34 and first movable plate 45 of tensive cutting head 30 presenting first array 27*a*. Similarly, second tensionable cutting member 20*b* attached to second raised portion 35 and second moveable plate 48 of tensive cutting head 30 presenting second array 27*b* which is rotated at approximately 90° on a plane substantially parallel to first array 27*a*.

Figure 4:
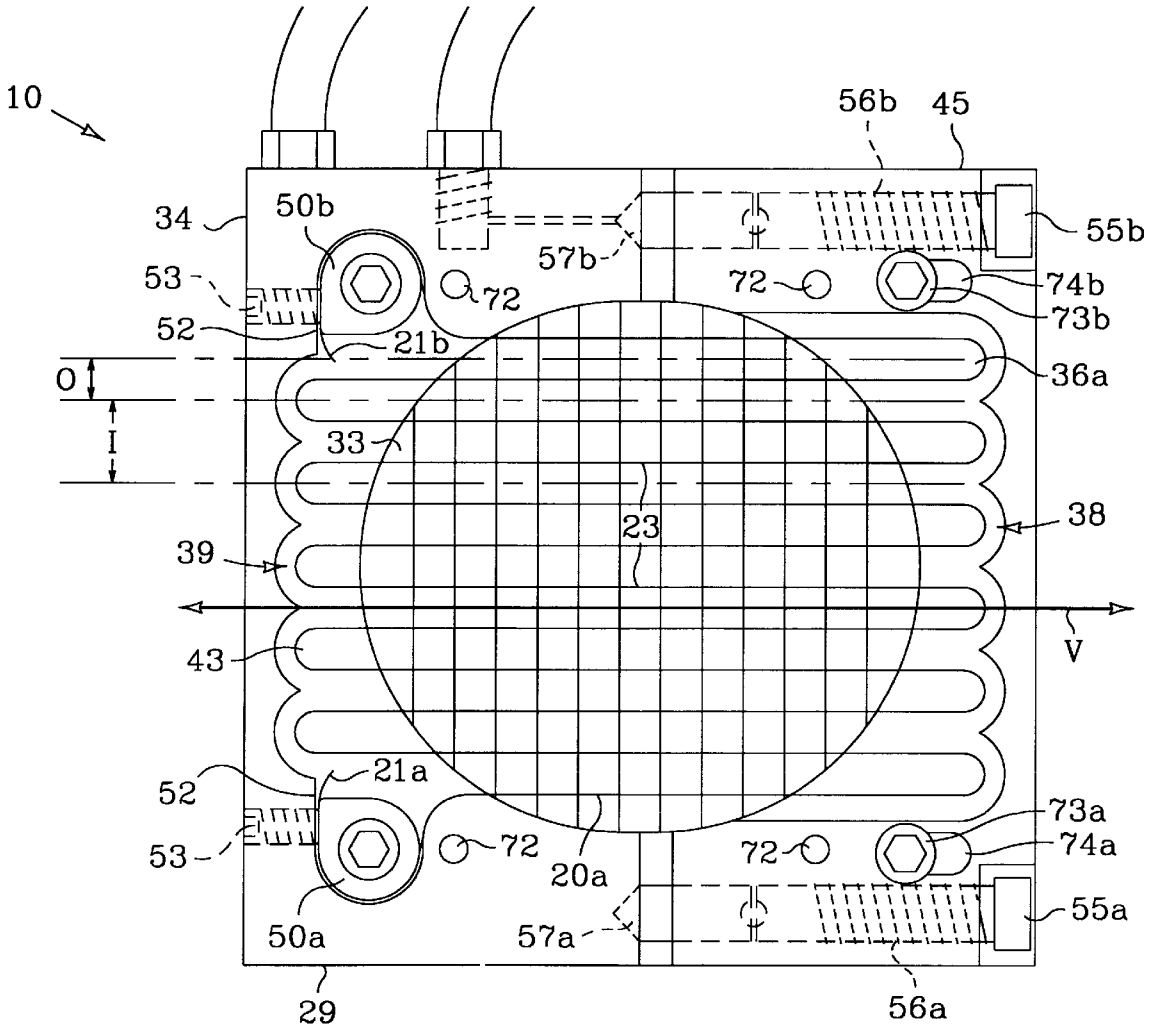
FIG. 4 is a representational first side view of one embodiment of the tensive cutting assembly.

As shown in FIG. 4, first tension adjustment screw 55*a* engages first threaded aperture 56*a* and seats in first hole 57*a*. Similarly, second tension adjustment screw 55*b* engages second threaded aperture 56*b* and seats in second hole 57*b*. First moveable plate 45 is secured in position on first face 31 by first retaining screw 73*a* which passes through first slot 74*a* and second retaining screw 73*b* which passes through second slot 74*b*. First moveable set of returns 38 is formed on the face of first moveable plate 45 near a peripheral edge of first moveable plate 45 such that when first tensionable cutting member 20*a* is positioned about first fixed set of returns 39 and first moveable set of returns 38, leg segments 23 of first tensionable cutting member 20*a* extend across aperture 33. Referring to FIG. 4, returns 36*a*, which are typical of the returns shown, are arranged sequentially, with an equal distance or return interval I being observed between each of the sequential returns. Opposing sets of returns have a lateral offset O substantially equal to the distance between two sequential tensionable cutting member leg segments. Referring to FIG. 4, tensive cutting head 30 also includes first clamping assembly 50*a* for securing first end 21*a* of tensionable cutting member 20*a* to tensive cutting head 30 and second clamping assembly 50*b* connected to tensive cutting head 30 for securing second end 21*b* of tensionable cutting member 20*a* to tensive cutting head 30. Similarly, referring to FIG. 3, tensive cutting head 30 also includes third clamping assembly 50*c* connected to tensive cutting head 30 for securing first end 22*a* of tensionable cutting member 20*b* to tensive cutting head 30 and fourth clamping assembly 50*d* connected to tensive cutting head 30 for securing second end 22*b* of tensionable cutting member 20*b* to tensive cutting head 30.

Referring to FIG. 4, first clamping assembly 50*a* is typical of the clamping assemblies in the shown embodiment and includes lock screw 53 which is tightened against first end 21*a* of tensionable cutting member 20*a* to prevent slippage. of first end 21*a*.

Figure 5:
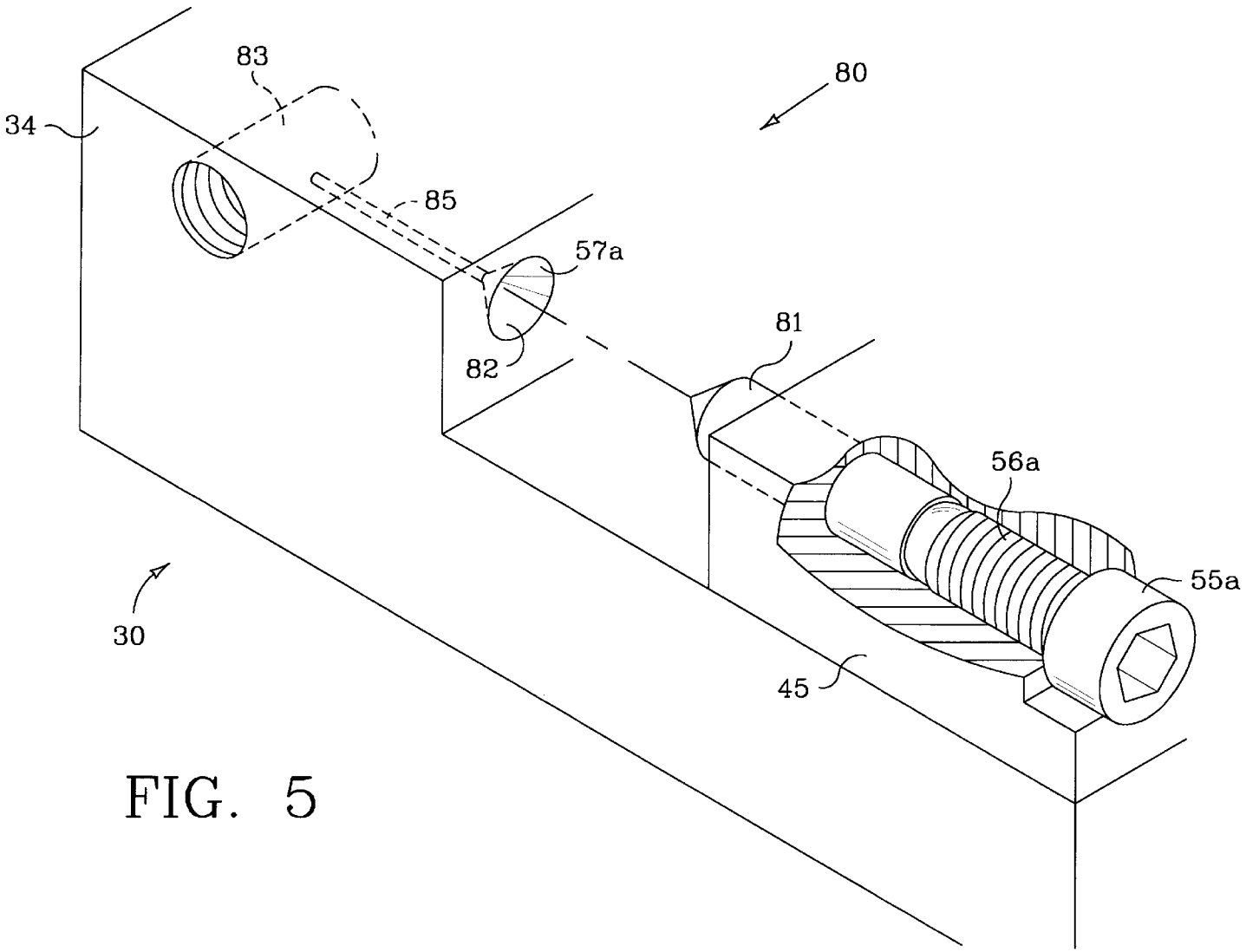
FIG. 5 is a representational perspective detail of one embodiment of a tensive cutting assembly including a portion of the tensionable cutting member failure sensing device.

Referring to FIG. 5, tensive cutting assembly 10 may include pneumatic failure sensing device 80. Sliding stop 81, is positioned in the distal end of first screw hole 56*a*. The end of first sliding stop 81 cooperates with the distal end of first tension adjustment screw 55*a*. The distal end of first screw hole 56*a* is sized and configured to permit a sliding fit between first sliding stop 81 and the distal end of first screw hole 56*a*. Hole 57*a* is configured having first seat 82. The distal end of first sliding stop 81 cooperates with first seat 82 sealing first fluid containment cell 83 when first tension adjustment screw 55*a* is tightened. First fluid containment cell 83 is shown in fluid communication with first seat 82 by passage 85.

A detail showing the relationship of various elements of failure sensing device 80 is shown in FIG. 5. Tensive cutting head 30 includes, in part, first moveable plate 45 and opposing first raised portion 34. First tension adjustment screw 55*a* is shown inserted in first screw hole 56*a*. First sliding stop 81 is shown cooperating with the distal end of first tension adjustment screw 55*a*. First sliding stop 81 has a conical tip which mates with first seat 82.

First air line 85 is fluidly connected to first fluid containment cell 83.

Figure 6:
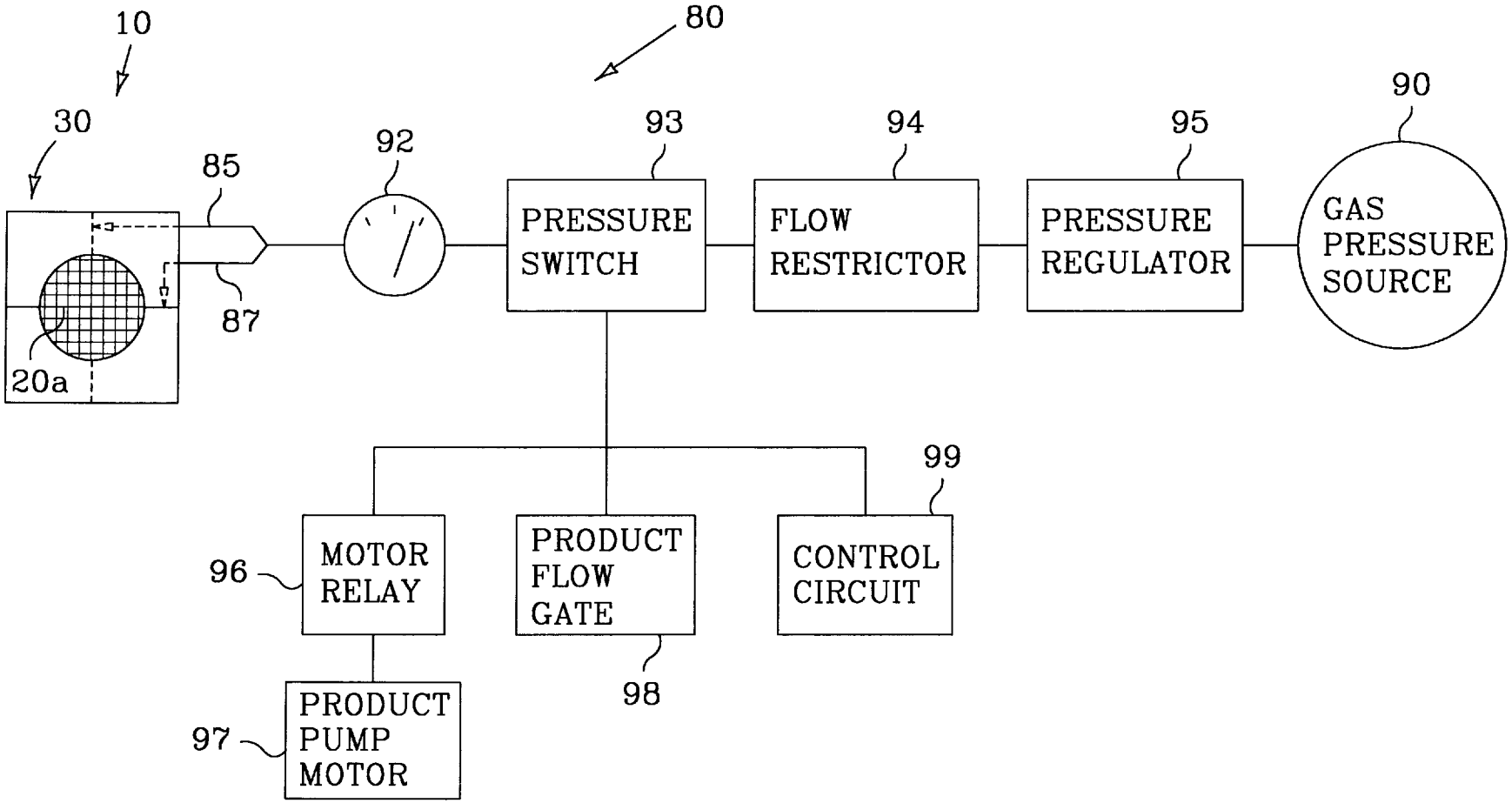
FIG. 6 is a schematic representation of one embodiment of the tensionable cutting member failure sensing device.

Referring to FIG. 6, failure sensing device 80 is shown including first air line 85 and second air line 87 which are removably attachable to tensive cutting head 30 of tensive cutting assembly 10. Pressure is provided to the system by a gas pressure source, in this instance, compressor 90. Pressure is regulated from the compressor by pressure regulator 95 and flow may be restricted by flow restricter 94. Pressure gauge 92 senses and displays system pressure. Pressure switch 93 is shown fluidly connected in series with compressor 90, first air line 85 and second air line 87. In the event of a failure or breakage of first tensionable cutting member 20*a,* air passes through the system lowering pressure activating pressure switch 93. As shown in FIG. 6, pressure switch 93 may be attached to a variety of components for signaling or controlling other components of the cutting system. FIG. 6 shows pressure switch 93 electrically connected to motor relay 96, product pump motor 97, product flow gate 98 and control circuit 99.

Figure 7:
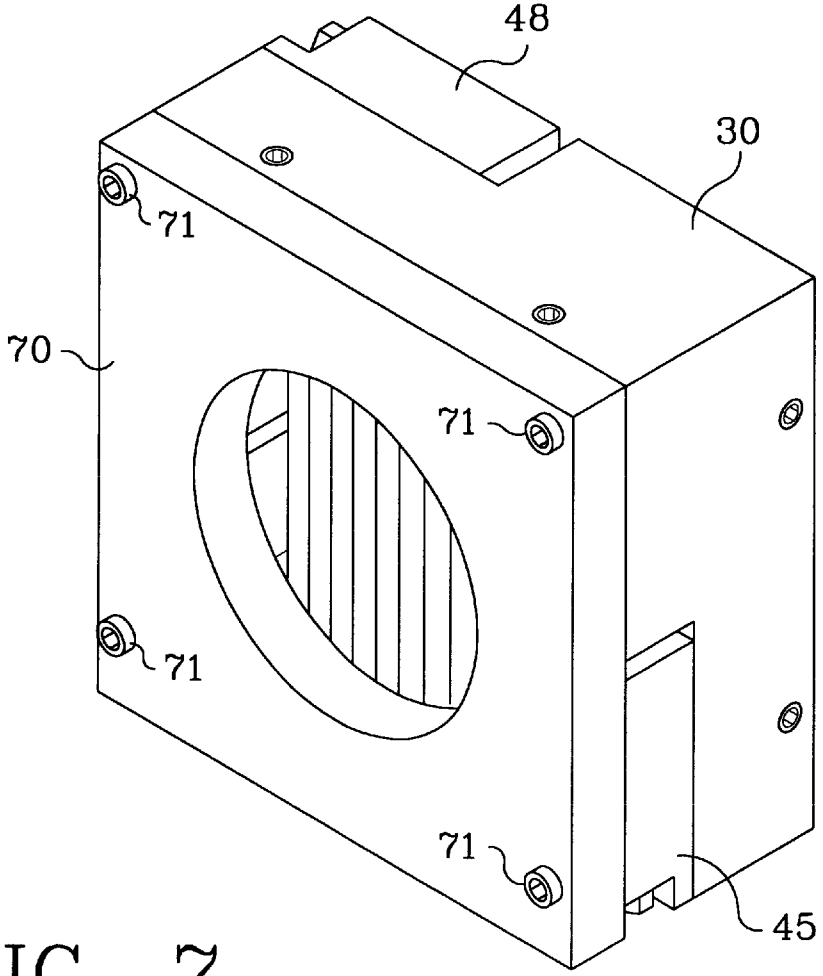
FIG. 7 is a representational perspective view of the tensive cutting assembly including an adapter plate.

Tensive cutting assembly 10 may also include one or more face plates. Referring to FIG. 7, face plate 70 is shown removably attached to tensive cutting head 30 by face plate screws 71. Face plate screws 71 pass through tensive cutting head 30 and secure face plate 70 to tensive cutting head 30 engaging face plate screw holes 72 shown in FIG. 4. In use, referring to FIGS. 2 and 3, first tension adjustment screw 55*a,* second tension adjustment screw 55*b* are backed out so that when first moveable plate 45 is placed on first face 31 of tensive cutting head 30, interface 75 of raised portion 34 and interface 76 of first moveable plate 45 contact one another. Referring to FIGS. 2, 3 and 4, first tensionable cutting member 20*a* is attached to first raised portion 34 and first movable plate 45 of tensive cutting head 30 by positioning bends 24 about returns 36*a*. The ends of tensionable cutting member 20*a* are positioned so as to engage the clamping assemblies. Referring to FIG. 4, with reference to clamping assembly 50*a,* first end 21*a* of tensionable cutting member 20*a* is secured by lock screw 53.

Once first tensionable cutting member 20*a* is positioned on first raised portion 34 and first movable plate 45 of tensive cutting head 30, first tension adjustment screw 55*a* and second tension adjustment screw 55*b* are turned so as to increase the distance between first raised portion 34 and first movable plate 45, In so doing, tensionable cutting member 20*a* is tensioned about first fixed set of returns 39 and first moveable set of returns 38.

As shown in FIG. 4, first tensionable cutting member 20*a* tightens across bearing faces 43 of first fixed set of returns 39 and first moveable set of returns 38 by a tensile force created by first tension adjustment screw 55*a* and second tension adjustment screw 55*b*. The tensive force is transferred to first tensionable cutting member 20*a* substantially parallel to force vector V and is distributed substantially equally across the width of tensionable cutting member 20*a*.

The procedure for installation of second tensionable cutting member 20*b* on second raised portion 35 and second moveable plate 48 is similiar to the process for installation of first tensionable cutting member 20*a* on first raised portion 34 and first movable plate 45.

Both first tensionable cutting member 20*a* and second tensionable cutting member 20*b* are tightened in the above manner to a point below the yield strength of the material being employed for the tensionable cutting member. Once tensioning is complete, referring to FIG. 7, face plate 70 may be attached to tensive cutting head 30 employing face plate screws 71 which engage face plate screw holes 72 as shown in FIG. 4.

Referring to FIG. 1, the completed tensive cutting assembly 10 is inserted within tensive cutting assembly housing 103. Food product is introduced into food product tank 100. Food product is drawn through food pump 101 into inlet tube 102 and through tensive cutting assembly housing. 103. Food product passes first against first tensionable cutting member 20*a* and then against second tensionable cutting member 20*b* before being discharged into outlet tube 104 in a stick configuration. From this point the sliced food product is carried through food processing discharge 105 to dewatering conveyor 106.

While this invention has been described with reference to the described embodiments, this is not meant to be construed in a limiting sense. Various modifications to the described embodiments, as well as additional embodiments of the invention, will be apparent to persons skilled in the art upon reference to this description. It is therefore contemplated that the appended claims will cover any such modifications or embodiments as fall within the true scope of the invention.

I claim:

1. A tensive cutting assembly comprising:

a tensive cutting head including a stationary portion including a clamping assembly and an opposing moveable portion including a return, the tensive cutting head further including an aperture formed through the tensive cutting head;

a tensionable cutting member including a first end, a second end, at least two leg segments and a bend connecting the two leg segments, the tensionable cutting member removably attached to the tensive cutting head with the bend positioned about the moveable return, the first end secured to the tensive cutting head and the second end secured by the clamping assembly;

the tensive cutting head also including a cutting member tensioning device disposed between the stationary portion and the opposing moveable portion for adjusting tension along the tensionable cutting member by adjusting a distance between the stationary portion and the opposing moveable portion;

a tensionable cutting member failure sensing device disposed between the stationary portion and the opposing moveable portion, the tensionable cutting member failure sensing device including a fluid containment cell including a seat, a slideable stop sealable against the seat for maintaining a pressure in the fluid containment cell, said seat disposed on one of said stationary and moveable portions and said stop disposed on the other of said stationary and moveable portions, a fluid pressure source fluidly connected to the fluid containment cell and a fluid pressure sensing device fluidly connected to the fluid containment cell for sensing a decrease in pressure in the fluid containment cell.

2. A tensive cutting assembly comprising:

a tensive cutting head including stationary portion including a clamping assembly and an opposing moveable portion including a return, a plurality of returns formed on the stationary portion and the opposing moveable portion, the tensive cutting head further including an aperture formed through the tensive cutting head;

a tensionable cutting member including a first end, a second end, a plurality of leg segments and a plurality of bends connecting the plurality of leg segments, the tensionable cutting member removably attached to the tensive cutting head with the bends are positioned about the plurality of returns, the first end secured to the tensive cutting head and the second end is secured by the clamping assembly;

the tensive cutting head also including a cutting member tensioning device disposed between stationary portion and the opposing moveable portion for adjusting tension along the tensionable cutting member by adjusting a distance between the stationary portion and the opposing moveable portion; and a tensionable cutting member failure sensing device disposed between the stationary portion and the opposing moveable portion, the tensionable cutting member failure sensing device including a fluid containment cell including a seat, a slideable stop sealable against the seat for maintaining a pressure in the fluid containment cell, said seat disposed on one of said stationary and moveable portions and said stop disposed on the other of said stationary and moveable portions, a fluid pressure source fluidly connected to the fluid containment cell and a fluid pressure sensing device fluidly connected to the fluid containment cell.

* * * * *